US005906271A

United States Patent [19]

Castonguay et al.

[11] Patent Number: 5,906,271

[45] Date of Patent: May 25, 1999

[54] MEANS OF REMOTE CHARGE INDICATION FOR HIGH AMPERE-RATED CIRCUIT BREAKERS

[75] Inventors: Roger N. Castonguay, Terryville; James L. Rosen, West Hartford, both of Conn.

[73] Assignee: General Electric Company, Schnectady, N.Y.

[21] Appl. No.: 08/693,934

[22] Filed: Aug. 5, 1996

Related U.S. Application Data

[60] Provisional application No. 60/002,675, Aug. 7, 1995.

[51] Int. Cl.[6] ..... H01H 5/00

[52] U.S. Cl. ..... 200/400; 200/401; 335/17

[58] Field of Search ..... 200/400, 401; 335/17, 6, 13

[56] References Cited

U.S. PATENT DOCUMENTS

| | | | |
|---|---|---|---|
| 2,460,758 | 2/1949 | Lawson | 335/17 |
| 3,214,537 | 10/1965 | Krieger | 335/17 |
| 4,001,742 | 1/1977 | Jencks et al. | 335/173 |
| 5,140,115 | 8/1992 | Morris | 335/17 |
| 5,264,673 | 11/1993 | Powell | 335/17 |
| 5,424,701 | 6/1995 | Castonguay et al. | 335/172 |
| 5,486,667 | 1/1996 | Castonguay et al. | 200/400 |
| 5,489,755 | 2/1996 | Castonguay et al. | 200/400 |

OTHER PUBLICATIONS

British Application #P87,407 M.A. Zaffetti, et als. Closing Arrangement for High Ampere–Rated Circuit Breakers Filed: Mar. 17, 1995 License No.: 506,162.

U.S. Ser. No. 08/315,385 M.A. Zaffetti, et als. Interlock for High Ampere–Rated Circuit Breaker Closing Springs Filed: Sep. 30, 1994 Docket No.: 41PR–7136.

U.S. Ser. No. 08/220,382 (Pat. #5,545,867—issuing on Aug. 13, 1996) R.N. Castonguay et als. A Motor Operator Interface Unit for High Ampere–Rated Circuit Breakers Filed: Mar. 30, 1994 Docket No.: 41PR–7121.

*Primary Examiner*—David J. Walczak
*Attorney, Agent, or Firm*—Fishman, Dionne, Cantor & Colburn; Carl B. Horton

[57] ABSTRACT

Remote indication of the charge state condition of the circuit breaker closing springs is provided by a remote indicating unit. The indicating unit interfaces with the circuit breaker closing assembly to actuate an electric switch in response to the position of the closing assembly. Actuation of the switch turns a on remote signal device when the closing spring is completely charged.

16 Claims, 5 Drawing Sheets

MEANS OF REMOTE CHARGE INDICATION FOR HIGH AMPERE-RATED CIRCUIT BREAKERS

Pursuant to 35 USC §119(e)(1), this patent is entitled to priority based upon United States Provisional Patent Application Ser. No. 60/002,675 filed on Aug. 7, 1995.

BACKGROUND OF THE INVENTION

U.S. Pat. No. 4,001,742 entitled "Circuit Breaker Having Improved Operating Mechanism" describes a circuit breaker capable of interrupting several thousand amperes of circuit current at several hundred volts potential. As described therein, the operating mechanism is in the form of a pair of powerful operating springs that are restrained from separating the circuit breaker contacts by means of a latching system. Once the operating mechanism has responded to separate the contacts, the operating springs must be recharged to supply sufficient motive force to the movable contact arms that carry the contacts.

U.S. Pat. No. 5,424,701, entitled "Operating Mechanism for High Ampere-Rated Circuit Breakers", describes an operating mechanism capable of immediately resetting the circuit breaker operating mechanism to reclose the contacts without having to recharge the circuit breaker operating springs immediately after opening the circuit breaker contacts.

U.S. Pat. No. 5,486,667, entitled "Rating Module Unit for High Ampere-Rated Circuit Breaker", describes a circuit breaker closing spring modular unit whereby the circuit breaker operating springs are contained within a separate unit from the operating mechanism, and can be installed within the circuit breaker enclosure without disturbing the operating assembly.

U.S. Pat. No. 5,489,755, entitled "Handle Operator Assembly for High Ampere-Rated Circuit Breaker", describes a handle operator unit capable of generating large spring charging force by means of an externally-accessible manually-operated handle. A ratchet and pawl assembly allows the manually-applied charging forces to be applied to the operating springs. Once the circuit breaker operating mechanism closing springs are fully-charged, some means must be employed to release the pawl to allow the closing springs to become fully operational.

British Provisional Application No. P87,407, filed Mar. 17, 1995, entitled "Closing Arrangement for High Ampere-Rated Circuit Breakers", describes an arrangement capable of releasing the fully charged closing springs.

U.S. patent application Ser. No. 08/315,385, filed Sep. 30, 1994, entitled "Interlock for High Ampere-Rated Circuit Breaker Closing Springs", describes a closing spring interlock arrangement, which provides a method to interlock the closing springs to insure that the closing springs are released only at the appropriate time.

U.S. patent application Ser. No. 08/220,382, filed Mar. 30, 1994, entitled "A Motor Operator Interface Unit for High Ampere-Rated Circuit Breakers", describes a simplified arrangement of an electric motor mechanism to automatically charge the circuit breaker closing springs.

SUMMARY OF THE INVENTION

When charging circuit breakers' operating springs, it is desirable to remotely indicate if the circuit breakers' operating springs are charged or discharged. This present invention relates to a method where an electrical switch is operated by a mechanical linkage system to indicate the charge state of a circuit breaker's operating springs.

BRIEF DESCRIPTION OF THE DRAWINGS

FIG. 3 is a plan side view depicting the remote charge indicating system in a state which indicates the circuit breaker's operating springs are discharged;

FIG. 4 is a plan side view depicting the remote charge indicating system in a state which indicates the circuit breaker's operating springs are fully charged.

FIG. 5 is a plan side view depicting the remote charge indicating system in a partially reset position, with the circuit breaker's operating springs moving from a charged state to a discharged state.

DESCRIPTION OF THE PREFERRED EMBODIMENT

Figure 1:
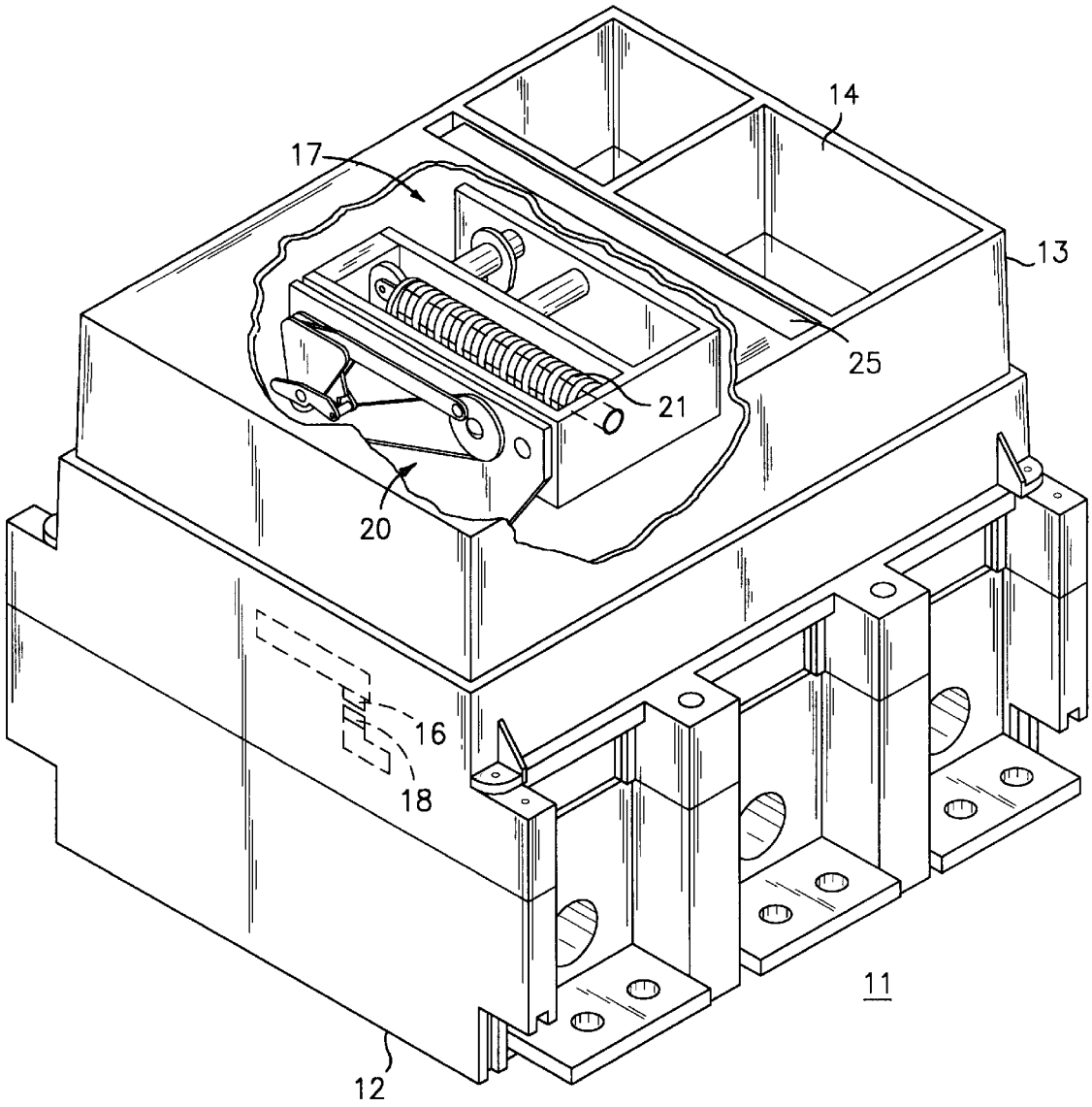
FIG. 1 is a top perspective view of a high ampere-rated circuit breaker with a portion of the circuit breaker removed to show the motor operator interface unit.

The motor interface unit 20 as in the high ampere-rated circuit breaker 11 controlled by the externally accessible operating handle 25 shown in FIG. 1 is capable of transferring several thousand amperes quiescent circuit current at several hundred volts potential without heating. An electronic trip unit (not shown) is arranged within the trip unit receptacle 14 in the circuit breaker cover 13 to control the operating mechanism 17. The closing spring 21 drives the circuit breaker contacts 16, 18 within the circuit breaker case 12 to their closed position. Although not described herein, the circuit breaker with the motor operator interface unit installed is as described within the aforementioned copending U.S. patent application Ser. No. 08/220,382, which is assigned to the assignee of the present invention.

Figure 2:
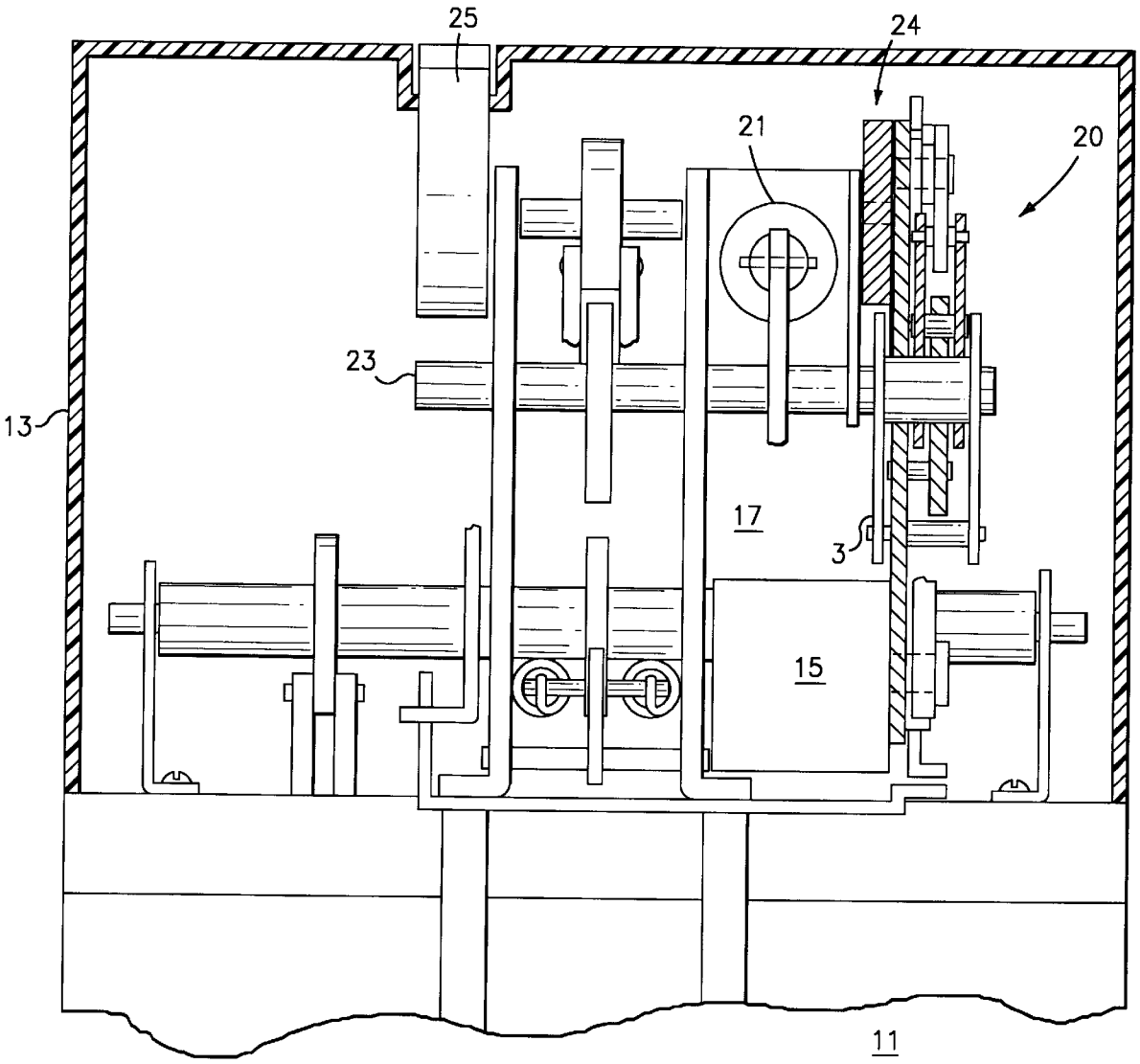
FIG. 2 is an end view depicting the remote charge indication system of the motor operator mechanism according to the invention as installed in a circuit breaker.

The positional relationship between the circuit breaker operating handle 25, remote charge indicating system 24, the circuit breaker operating mechanism 17, and the motor interface unit 20 is shown in FIG. 2. The closing spring 21 connects with the closing shaft 23 and the electric charging motor 15 connects with the closing shaft by means of the charging plates 3. The operation of these components within the cover 13 of the circuit breaker 11 are described in the aforementioned U.S. Patents, U.S. Patent Applications and the British Provisional Application.

Figure 3A:
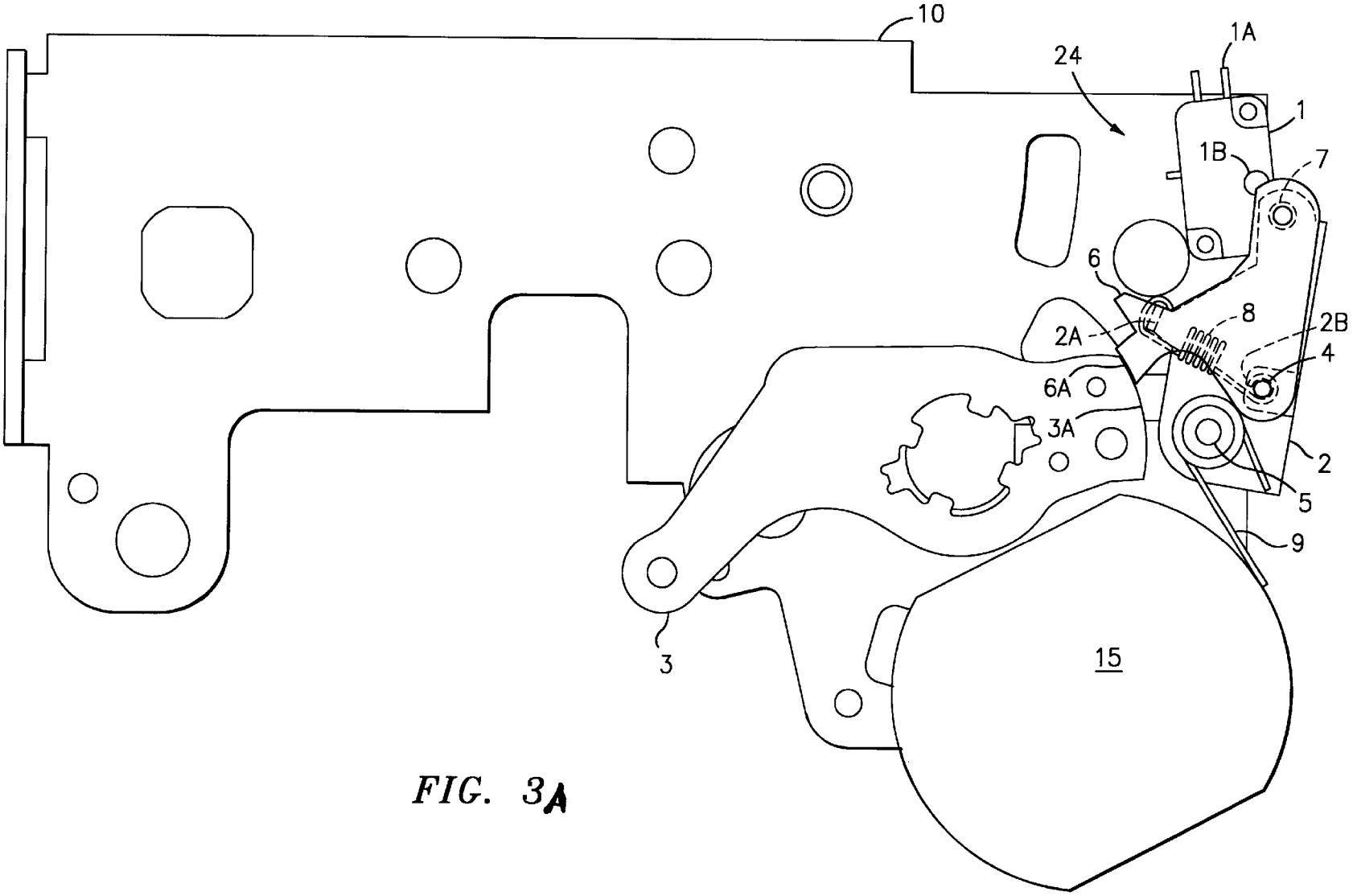
FIG. 3*a* is an exploded view of region 3*a* of FIG. 3 depicting switch button 1B in an open or unactuated position.

The remote charge indicating system 24 operates in a manner depicted in FIG. 3 to indicate that the circuit breaker's closing spring 21 (FIG. 1) is discharged. The switch 1 is secured to the operating mechanism sideframe 10. The charge plate 3 is pivotally mounted on the sideframe and shown rotated clockwise to the closing springs' discharged position. A good description of the operation of the charge plate and the charging motor 15 is found in the aforementioned U.S. patent application Ser. Number 08/220,382. The cam 6 is mounted to the operating link 2 by pin 7 and biased in a clockwise direction by cam spring 8. The cam spring is mounted between a tab 2*a* extending from the operating link 2 and the stop pin 4, which extends from the cam 6. Cam 6 rotates in a clockwise direction until the stop pin 4 contacts the surface 2*b* of the operating link 2, forcing the operating link 2 and the cam 6 to rotate as a single unit about the bushing 5. The operating link 2 is mounted to the sideframe 10 by means of the bushing 5 and is biased in a counter-clockwise direction by means of the torsion spring 9 until the surface 6*a* of the cam 6 contacts the surface 3*a* of the charge plate 3. By the interaction of surface 6*a* of cam 6 and 3*a* of charge plate 3, and cam 6 moving as a single unit with the operating link 2, the operating link 2 is prevented from actuating the button 1B on switch 1 as shown in FIG. 3*a*. Switch 1 is wired for normally-open contacts to indicate by connection with a remote indicating lamp by means of the switch connectors 1A that the closing springs are discharged.

Figure 4A:
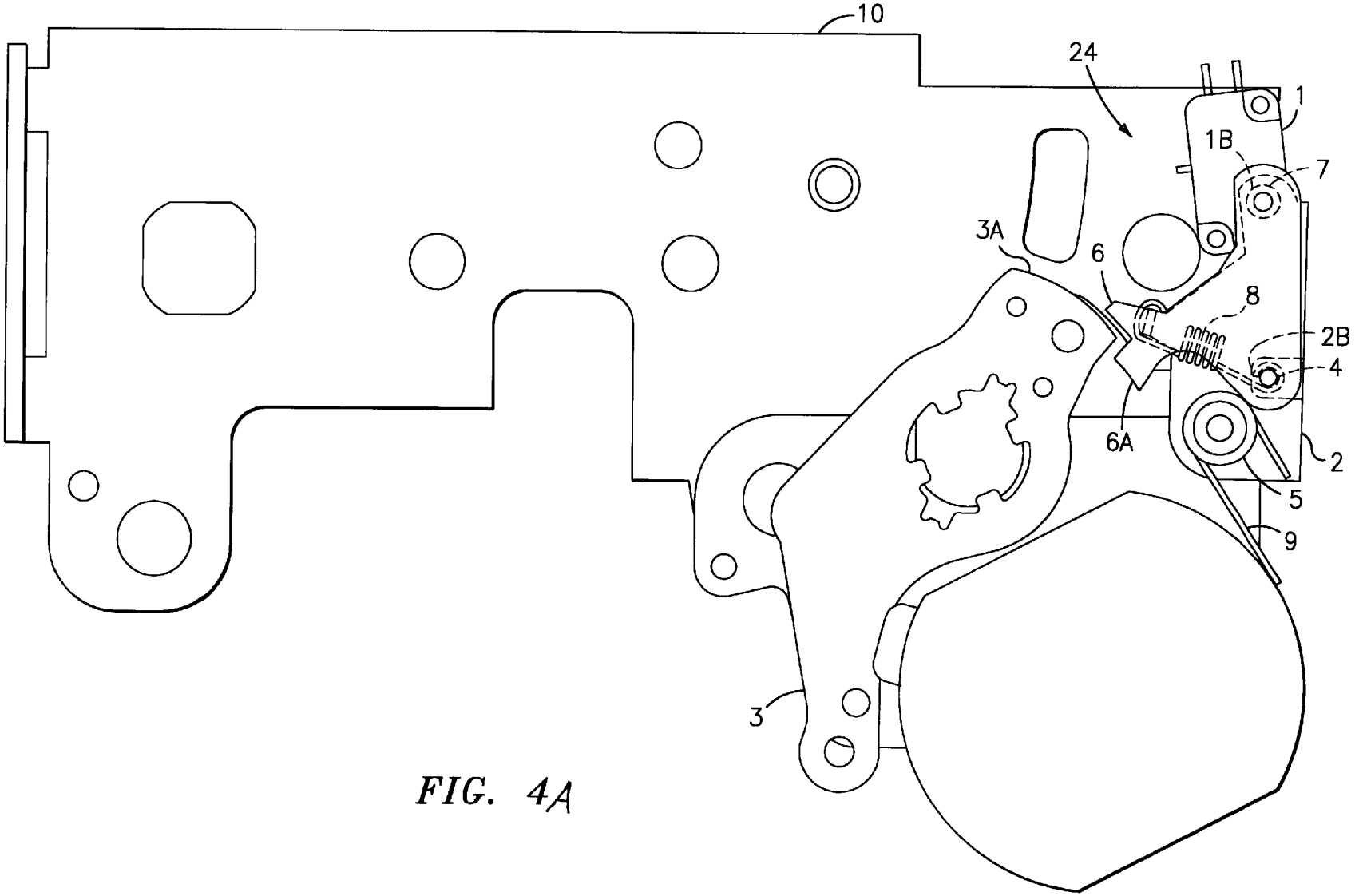
FIG. 4*a* is an exploded view of region 4*a* of FIG. 4 depicting switch button 1B in a closed or actuated position.

In FIG. 4, the remote charge indicating system 24 is in a state showing that the operating springs are fully charged. The charge plate 3 is rotated counterclockwise to bring the closing springs to the fully-charged position. The surface 6*a* on the cam 6 comes out of contact with the surface 3*a* of the charge plate 3, which allows the operating link 2 and cam 6 to rotate counter-clockwise as a unit into contact with the button 1B on switch 1 as shown in FIG. 4*a*. With the operating link 2 in contact with switch button 1B, the contacts of the switch 1 change to a closed state to provide remote indication that the closing springs are fully charged.

Figure 5A:
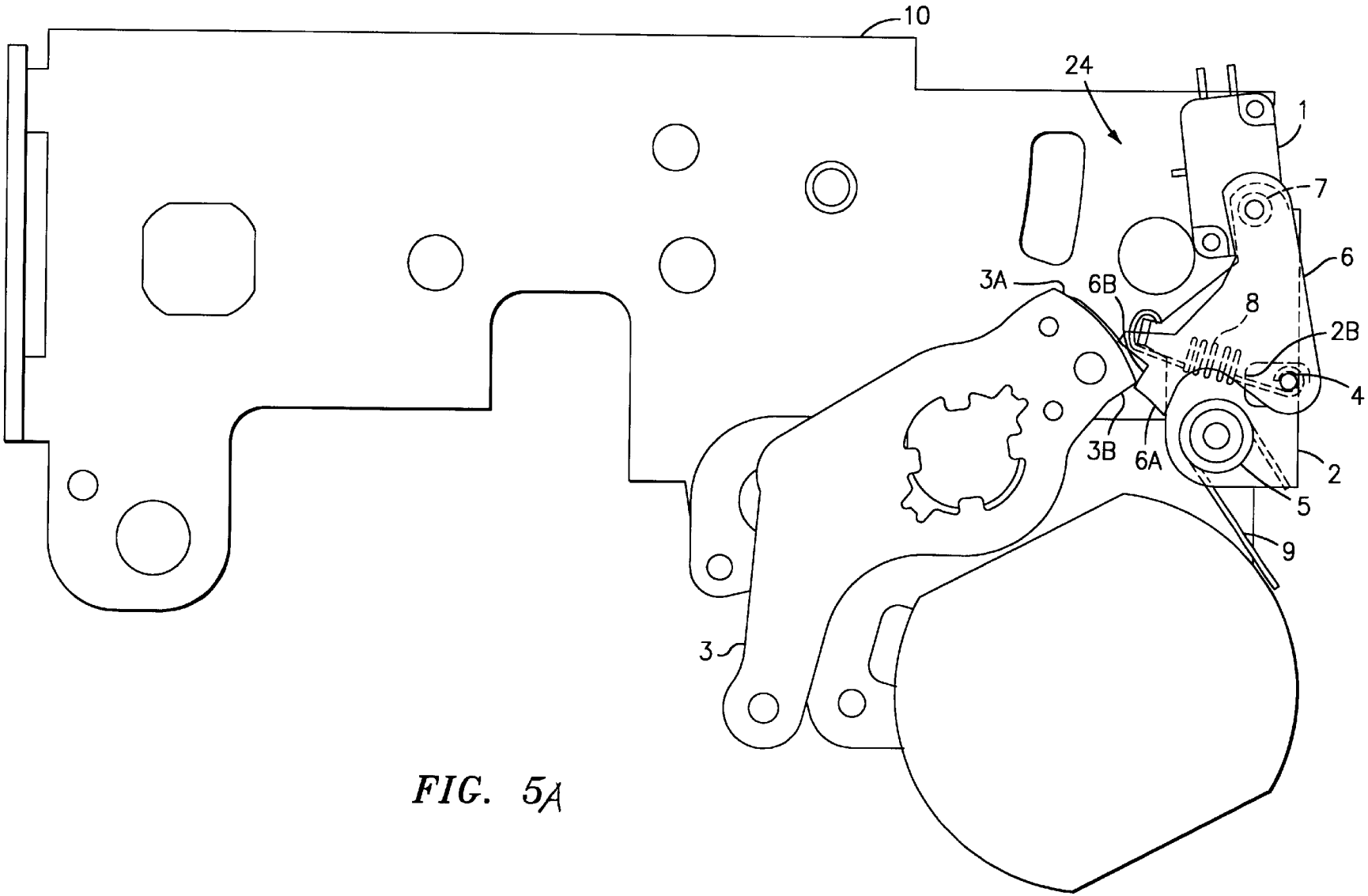
FIG. 5*a* is an exploded view of region 5*a* of FIG. 5 depicting switch button 1B in an open or unactuated position.

In FIG. 5, the remote charge indicating system 24 it in a partially reset position. The charge plate 3 is rotated clockwise from the closing springs' charged position of FIG. 4. The geometry is such that the cam 6 will rotate clockwise extending the cam spring 8, until the surface 6*b* on cam 6 clears the surface 3*b* on the charge plate 3, at which point the cam will rotate clockwise under the return bias provided by the cam spring 8. This drives the surface 6*a* of the cam onto surface 3*a* of the charge plate 3, forcing the operating link 2 to rotate clockwise out of engagement with the switch button 1B, changing the state of the switch 1 to its open condition as shown in FIG. 5*a*.

We claim:

1. A circuit breaker closing spring remote indicator unit for indicating the status of a closing spring for driving circuit breaker contacts defining a first conductive path comprising:

an electric switch defining a second conductive path different from said first circuit path for connecting with a remote indicator;

a charging device connecting with an electric motor for charging a circuit breaker closing spring;

an operating link intermediate said electric switch and said charging device; and a cam pivotally connected to said operating link for actuating said electric switch for indication as to whether said circuit breaker closing spring is in a charged or discharged condition.

2. The circuit breaker closing spring remote indicator unit of claim 1 wherein said operating link is attached to said cam by a spring, a first end of said spring attached to said cam and a second end of said spring attached to said operating link.

3. The circuit breaker closing spring remote indicator unit of claim 1 wherein said cam includes a camming surface arranged in abutment with an end of said charging device.

4. The circuit breaker closing spring remote indicator unit of claim 1 wherein said charging device comprises a charge plate.

5. The circuit breaker closing spring remote indicator unit of claim 1 wherein said electric switch includes an actuator button.

6. The circuit breaker closing spring remote indicator unit of claim 5 wherein said cam further includes a pin extending from one side thereof, said pin contacting said operating link causing said operating link to motivate said actuator button when said closing spring is in a charged condition.

7. The circuit breaker closing spring remote indicator unit of claim 1 wherein said electric switch contains normally open contacts.

8. The circuit breaker closing spring remote indicator unit of claim 1 wherein said electric switch is mounted on an operating mechanism side frame.

9. A circuit breaker comprising:

an electrically-insulative case and cover; a pair of separable contacts within said case;

a closing spring within said cover arranged for moving said contacts to closed condition;

an electric motor arranged for moving said closing spring to a charged condition; and a circuit breaker closing spring remote indicator unit comprising:

an electric switch for connecting with a remote indicator;

a charging device connecting with an electric motor for charging said closing spring;

an operating link intermediate said electric switch and said charging device; and a cam interacting with said operating link for actuating said electric switch for indication as to whether said circuit breaker closing spring is in a charged or discharged condition.

10. The circuit breaker of claim 9 wherein said operating link is attached to said cam by an extension spring.

11. The circuit breaker of claim 9 wherein said cam includes a camming surface arranged in abutment with an end of said charging device.

12. The circuit breaker of claim 9 wherein said charging device comprises a charge plate.

13. The circuit breaker of claim 9 wherein said electric switch includes an actuator button.

14. The circuit breaker of claim 13 wherein said cam further includes a pin extending from one side thereof, said pin contacting said operating link causing said operating link to motivate said actuator button when said closing spring is in a charged condition.

15. The circuit breaker of claim 9 wherein said electric switch contains normally open contacts.

16. The circuit breaker of claim 9 wherein said electric switch is mounted on an operating mechanism side frame.

* * * * *